United States Patent [19]

Mullen et al.

[11] 3,951,829

[45] Apr. 20, 1976

[54] TWO-CYCLE AND ROTARY COMBUSTION ENGINE LUBRICANT

[75] Inventors: Theodore R. Mullen, Freehold; William J. Lendener, Old Bridge, both of N.J.

[73] Assignee: Cities Service Company, Tulsa, Okla.

[22] Filed: May 5, 1975

[21] Appl. No.: 574,476

[52] U.S. Cl. ..... 252/32.5; 44/58; 252/33

[51] Int. Cl.[2] ..... C10M 1/44; C10M 3/38; C10M 5/24; C10M 7/24

[58] Field of Search ..... 252/32.5, 33; 44/58

[56] References Cited

UNITED STATES PATENTS

| | | | |
|---|---|---|---|
| 3,330,762 | 7/1967 | Wendler et al. | 252/32.5 |
| 3,838,049 | 9/1974 | Gouillard et al. | 252/32.5 |
| 3,859,218 | 1/1975 | Jervis et al. | 252/32.5 |

*Primary Examiner*—Delbert E. Gantz
*Assistant Examiner*—I. Vaughn
*Attorney, Agent, or Firm*—John W. Carpenter

[57] ABSTRACT

An improved two-cycle and rotary combustion engine lubricant comprising a 2-cycle engine oil, an additive comprising between about 54 wt. % and 74 wt. % of a mixture of alkylated aryl ammonium salts of alkyl phosphate and between about 15 wt. % and 27 wt. % of a mineral oil having a viscosity at 100°F of between about 100 N SUS and 650 N SUS. The additive additionally includes between about 5 wt. % and 15 wt. % of alkylated diarylamines having a formula selected from the group consisting of

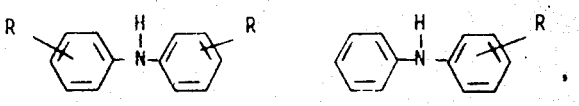

and mixtures thereof, wherein R has between about 4 and about 20 carbon atoms, and between about 1 wt. % and 9 wt. % of a lithium dialkylarylsulfonate, the additive comprises from about 0.1 wt. % to about 1.0 wt. % of the lubricant.

9 Claims, No Drawings

TWO-CYCLE AND ROTARY COMBUSTION ENGINE LUBRICANT

BACKGROUND OF THE INVENTION

1. Field of the Invention

This invention is related to a lubricant. More specifically, this invention provides a 2-cycle and rotary combustion engine lubricant.

2. Description of the Prior Art

This invention consists of adding small portions of a sulfur-phosphorus additive to a 2-cycle lubricant. No prior art is known which teaches or suggests the sulfur-phosphorus additive 2-cycle lubricant of this invention. The additive imparts ep-anti scuff properties, better cleanliness, and anti-ring sticking qualities to the lubricant.

SUMMARY OF THE INVENTION

It is therefore an object of this invention to provide an improved 2-cycle and rotary combustion engine lubricant.

It is another object of this invention to provide an improved 2-cycle and rotary combustion engine lubricant which includes ep-anti scuff properties, better cleanliness, and anti-ring sticking qualities.

Still other objects will be apparent to those skilled in the art from the following discription of this invention.

The foregoing objects are achieved according to the practice of this invention. Broadly, this invention comprises a 2-cycle engine oil; an additive comprising between about 54 wt.% and 74 wt.% of a mixture of a alkylated aryl ammonium salt of alkyl phosphate and a di(alkylated aryl ammonium) salt of an alkyl phosphate; between about 15 wt.% and 27 wt.% of a mineral oil having a viscosity at 100°F of between about 100 N SUS and 650 N SUS; between about 5 wt.% and 15 wt.% of alkylated diarylamines having a formula selected from the group consisting of

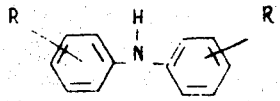

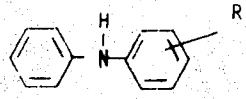

and mixtures thereof and mixtures thereof, wherein R has between 4 and 20 carbon atoms; and between about 1 wt.% and 9 wt.% of a lithium dialkylarylsulfonate. The additive comprises from about 0.1 wt.% to about 1.0 wt.% of the lubricant.

Thus, by the practice of this invention, there is provided a 2-cycle and rotary combustion engine lubricant which provides ep-anti scuff properties, better engine cleanliness, and antiring sticking qualities.

DETAILED DESCRIPTION OF THE INVENTION

This invention is an improved 2-cycle and rotary combustion engine lubricant comprising a 2-cycle engine oil, and an additive which includes between about 54 wt.% and 74 wt.% of a mixture of alkylated aryl ammonium salts of alkyl phosphate; and between about 15 wt.% and 27 wt.% of a mineral oil having a viscosity at 100°F of between about 100 N SUS and 650 N SUS. The additive also comprises between about 5 wt.% and 15 wt.% of alkylated diarylamines having a formula selected from the group consisting of

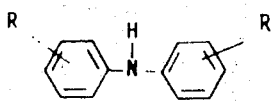

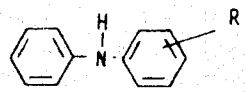

and mixtures thereof, wherein R has between about 4 and about 20 carbon atoms. The additive also has between about 1 wt.% and 9 wt.% of a lithium dialkylaryl sulfonate. The lubricant comprises from about 0.1 wt.% to about 1.0 wt.% of the lubricant.

It has been discovered that the mixture of alkylated aryl ammonium salts of alkyl phosphate preferably comprises about 64 wt.% of the additive. A preferred amine is aniline; therefore, the respective general formulas for the mixture of alkylated aryl ammonium salt of the alkyl phosphate and the di(alkylated aryl ammonium) salt of the alkyl phosphate are as follows:

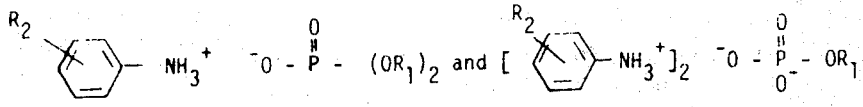

where $R_1$ is an alkyl having from 1 to 7 carbon atoms and $R_2$ is an alkyl having 6 to 18 carbon atoms. Preferably, $R_1$ has 1 or 4 carbon atoms, and $R_2$ has 12 carbon atoms.

We have found that the additive preferably includes a 10 wt.% mixture of the alkylated diarylmines. Since in a preferred embodiment the aryl is phenyl, the mixture preferably includes the following two compounds mixed in any suitable ratio of from between about 20:80 to about 80:20, respectively:

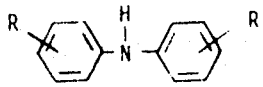

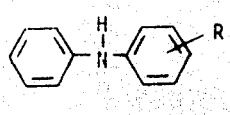

wherein R is an alkyl having from 1 to about 20 carbon atoms. Most preferred, R is an alkyl with 8 carbon atoms.

It has also been discovered that the additive preferably comprises approximately 5 wt.% of the lithium dialkylarylsulfonate. The aryl may be selected from the group consisting of napthyl, phenyl, and anthracyl. In a preferred embodiment of the invention the aryl is napthyl; therefore, the preferred general formula for the lithium dialkylaryl sulfonate is:

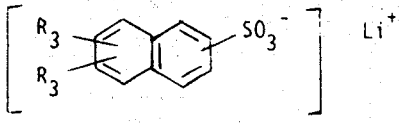

wherein $R_3$ is an alkyl having from between about 4 carbon atoms and 20 carbon atoms. More preferably, $R_3$ is an alkyl having 9 carbon atoms.

We have also found that the mineral oil, well known to those possessing ordinary skill in the art, should comprise about 21 wt.% of the additive in a preferred embodiment of the invention. Most preferably, the mineral oil has a viscosity at 100°F of about 350 N SUS.

The 2-cycle engine oil disclosed and claimed in the present invention is well known to those possessing ordinary skill in the art and comprises from between about 99.0 wt.% to about 99.9 wt.% of the lubricant. Any suitable low h.p. 2-cycle engine oil may be used in the present invention, such as those possessing the following average properties: 31.6°API gravity, 7.224 lbs./gal., 150°F flash point, a viscosity SUS at 100°F of about 181.1, a pour point of about −40°F, a carbon residue (ASTM D 524) of about 0.10%, a sulfated ash content (ASTM D 874) of less than about 10 ppm, a total acid number (ASTM D 664) of about 1.3, and a nitrogen and sulfur content of respectively 0.56% and about 20%.

In the following is set forth examples of our invention which are given by way of illustration and not limitation. The specific concentrations, compounds, etc. set forth in these examples are not to be construed to unduly limit the scope of the invention.

EXAMPLE I 2-cycle engine oil was mixed with about 0.5 wt.% of the following lubricant: 32 wt.% dodecylaniline salt of methyl acid phosphate, 32 wt.% dodecylaniline salt of butyl acid phosphate, 21 wt.% mineral oil, 10 wt.% of a mixture of

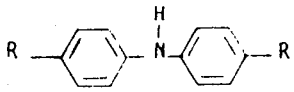

and

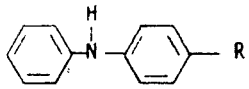

wherein R = $C_8H_{17}$ and 5% lithium dimonylnaphthalenesulfonate. No particular order or procedure is needed for admixing any of the compounds. This oil-lubricant mixture was 20 hour tested at half throttle (6000 RPM) in a Yamaha motorcycle having the A/F ratio adjusted to result in 1000°F average combustion chamber temperature. A similar test was run with the 2-cycle engine oil alone. The results showing substantial reduced ring sticking are given below:

TABLE I

| Fuel/2-Cycle Oil | Ring Sticking | | Overall Cleanliness Rating |
|---|---|---|---|
| | 1 | 2 | |
| 24/1 | 50 | 0 | 8.1 |
| 50/1 | 100 | 60 | 6.7 |

TABLE II

| Fuel/2-Cycle Oil & Lubricant | Ring Sticking | | Overall Cleanliness Rating |
|---|---|---|---|
| | 1 | 2 | |
| 24/1 | 0 | 0 | 8.0 |
| 50/1 | 0 | 0 | 6.6 |

EXAMPLE II

Repeat Example I but vary the mixing ratios of the mixture of octylated diphenylamines from 20:80 to 80:20 and find similar results.

EXAMPLE III

Repeat Example II but vary the wt.% of the lubricant in 0.1 wt.% increments between 0.1 wt.% to 1.0 wt.% and find similar results.

EXAMPLE IV

Repeat Example III but change the dodecylaniline salt of both the methyl and butyl acid phosphate to an alkylated aniline salt wherein the alkyl group is varied 1 carbon atom at a time from 6 carbon atoms to 18 carbon atoms. Similar results are found.

EXAMPLE V

Repeat Example IV but vary the wt.% of the monoalkylaniline and di(monoalkylaniline) salt of the methyl and butyl acid phosphate in 5 wt.% increments from 54 wt.% and 74 wt.% and find similar results.

EXAMPLE VI

Repeat Example V but vary the alkyl (methyl and butyl) group of the acid phosphate in 1 carbon atom increments between 1 carbon atom to 7 carbon atoms and find similar results.

EXAMPLE VII

Repeat Example VI but vary the wt.% in 1 wt.% increments of the mineral oil between 15 wt.% and 27 wt.% and find similar results.

EXAMPLE VIII

Repeat Example VII but vary the viscosity of the mineral oil at 100°F in 50 N SUS increments between 100 N SUS and 650 N SUS and find similar results.

EXAMPLE IX

Repeat Example VIII but vary the wt.% of the octylated diphenylamines in 1 wt.% increments between 5 wt.% and 15 wt.% and find similar results.

EXAMPLE X

Repeat Example IX but change the mixture of the octylated diphenylamines to the series of alkylated diphenylamines wherein the alkyl group is varied 1 carbon atom at a time from 4 carbon atoms to 20 carbon atoms, and find similar results.

EXAMPLE XI

Repeat Example X but vary the R, an alkyl, of

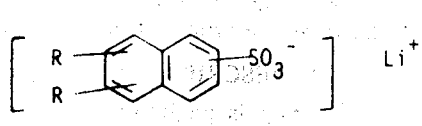

in 1 carbon increments between 4 carbon atoms and 20 carbon atoms, and find similar results.

EXAMPLE XII

Repeat Example XI but vary the wt.% of the $Li^+$ compound in 1 wt.% increments between 1 wt.% and 9 wt.% and find similar results.

EXAMPLE XIII

Falex lubricant tester measures load and wear produced by extreme pressure forces. Higher jaw loads indicate load carrying capacity of lubricants.

TABLE III

| Compound | Jaw Load, Lb. Gauge |
|---|---|
| 2-Cycle Engine Oil | 300 – 400 Av. |
| 2-Cycle Engine Oil Plus 0.1 Wt.% of Lubricant Additive of Example I | 500 |
| 2-Cycle Engine Oil Plus 0.25 Wt.% of Lubricant Additive of Example I | 2600 |
| 2-Cycle Engine Oil Plus 0.50 Wt.% of Lubricant Additive of Example I | 3000 |

EXAMPLE XIV

Repeat Example XII in acccordance with each procedure of Examples II–XII and find the similar results given in Example XIV.

EXAMPLE XV

NBS (National Bureau of Standard) test: measures deposit forming tendencies at 482°F. Test oil is dripped on inclined channel at specified rate for given length of time. Ratings are 1 to 4. Rating 1 is clean and 4 rating indicates heavy deposit.

TABLE IV

| Compound | Rating |
|---|---|
| 2-Cycle Engine Oil | 4 |
| 2-Cycle Engine Oil Plus 0.1 Wt.% of Lubricant Additive of Example I | 3 |
| 2-Cycle Engine Oil Plus 0.25 Wt.% of Lubricant Additive of Example I | 3 |
| 2-Cycle Engine Oil Plus 0.5 Wt.% of Lubricant Additive of Example I | 1 |

EXAMPLE XVI

Repeat Example XV in accordance with each procedure of Examples II–XII and find the similar results given in Example XV.

EXAMPLE XVII

BIA-TCW (Boating Industries of America — Two Cycle Water Cooled) scuffing test: use the BIA-TCW phase I scuffing procedure, 10 minute operation at WOT (Wide Open Throttle). Found 2-cycle engine oil alone scuffed at 200/1 F/O ratio, and did not scuff at 150/1 F/O ratio, using standard leaded fuel. Using 2-cycle engine oil plus 0.5 wt.% additive of Example I, found did not scuff at 200/1 F/O ratio standard procedure using leaded fuel or unleaded fuel.

EXAMPLE XVIII

Repeat Example XVII in accordance with each procedure of Examples II-XII and find the similar results given in Example XVII.

EXAMPLE XIX

Evaluation using Canadian Curtis Wright Engine: 440. Conditions of tests: engine run at WOT for 10 minute intervals starting at 50/1 fuel to oil ratio. The fuel to oil ratio is increased as follows: from 50/1 to 100/1, to 200/1, to 300/1, and to 400/1. 10 minute operation without scuffing is considered acceptable to show anti scuff property. Results are as follows:

A. 2-cycle engine oil: repeat tests show scuffing to take place after 2 to 8 minutes operation at fuel to oil ratio of 300/1.

B. 2-cycle engine oil plus 0.5 wt.% of additive of Example I: repeat tests show full protection at fuel to oil ratios of 400/1 for as long as 3 hours, rather than just for the required 10 minutes.

EXAMPLE XX

Repeat Example XIX in accordance with each procedure of examples II-XII and find the similar results given in Example XIX.

While the present invention has been described herein with reference to particular embodiments thereof, and specific examples, a latitude of modifications, various changes and substitutions are intended in the foregoing disclosure, and in some instances some features of the invention will be employed without a corresponding use of other features without departing from the scope of the invention as set forth.

We claim:

1. An improved 2-cycle and rotary combustion engine lubricant comprising a 2-cycle engine oil, an additive comprising between about 54 wt.% and 74 wt.% of a mixture of an alkylated aryl ammonium salt of an alkyl phosphate and a di(alkylated aryl ammonium) salt of an alkyl phosphate, between about 15 wt.% and 27 wt.% of a mineral oil having a viscosity at 100°F of between about 100 N SUS and 650 N SUS, between about 5 wt.% and 15 wt.% of alkylated diarylamines having a formula selected from the group consisting of

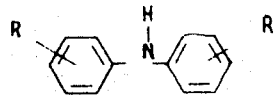

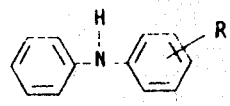

and mixtures thereof, wherein R is an alkyl having between about 4 and 20 carbon atoms, between about 1 wt.% and 9 wt.% of a lithium dialkylaryl sulfonate, said additive comprising from about 0.1 wt.% to about 1.0 wt.% of the lubricant.

2. The lubricant of claim 1 wherein said lithium dialkylaryl sulfonate includes an aryl selected from the group consisting of naphthyl, phenyl, and anthracyl, and an alkyl having between about 4 and 20 carbon atoms.

3. The lubricant of claim 2 wherein said lithium dialkylaryl sulfonate comprises about 5 wt.% of said additive and has the formula:

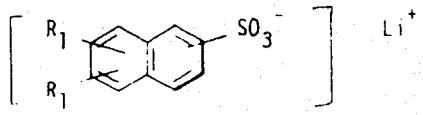

wherein $R_1$ has 9 carbon atoms.

4. The lubricant of claim 3 wherein said mixture of alkylated diarylamine comprises about 10 wt.% of said additive.

5. The lubricant of claim 4 wherein said mixture of alkylated diarylamine comprises

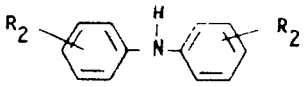

and

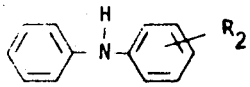

mixed in a ratio of between about 20:80 to 80:20 wherein $R_2$ is an alkyl having between about 4 and 20 carbon atoms.

6. The lubricant of claim 5 wherein said mixture of

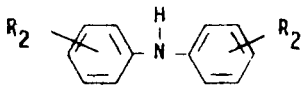

and

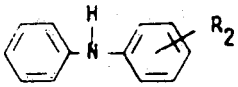

comprises equal proportions of same and $R_2$ is an alkyl having 8 carbon atoms.

7. The lubricant of claim 6 wherein said mixture of alkylated aryl ammonium salts of alkyl phosphate and di(alkylated aryl ammonium) salt of an alkyl phosphate comprises about 64 wt.% of said additive and respectively includes the compounds having the following formulas mixed in a ratio of from between 2:1 to 1:2:

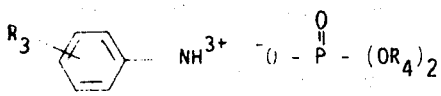

and

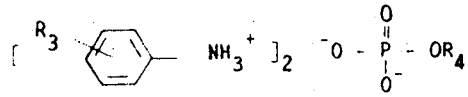

wherein $R_3$ is an alkyl having from 6 to 18 carbon atoms and $R_4$ is an alkyl having from 1 to 7 carbon atoms.

8. The lubricant of claim 7 wherein said mixture of compounds having the following formulas are mixed in a ratio of 1:1:

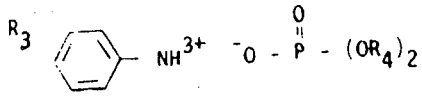

and

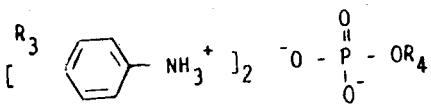

wherein $R_3$ is an alkyl having 12 carbon atoms and $R_4$ is an alkyl having 1 or 4 carbon atoms.

9. The lubricant of claim 8 additionally including adding said lubricant to a 2-cycle combustion engine for providing ep-anti scuff properties, better engine cleanliness, and anti-ring sticking qualities.

* * * * *